United States Patent [19]

Stuff, Jr.

[11] 4,431,192

[45] Feb. 14, 1984

[54] GOLF CLUB HEAD

[76] Inventor: Alfred O. Stuff, Jr., 1603 Camerbur St., Orlando, Fla. 32805

[21] Appl. No.: 232,212

[22] Filed: Feb. 6, 1981

[51] Int. Cl.[3] ..... A63B 53/04

[52] U.S. Cl. ..... 273/167 E; 273/174

[58] Field of Search ..... 273/77 R, 162 R, 163 R, 273/164, 167–175, 183 D, 186 R, 186 A, 193 R, 193 A, 194 R, 194 A; D21/214

[56] References Cited

U.S. PATENT DOCUMENTS

| | | | |
|---|---|---|---|
| D. 192,515 | 4/1962 | Henrich | 273/167 E X |
| D. 240,748 | 7/1976 | Bock | 273/167 E X |
| 1,396,470 | 11/1921 | Taylor | 273/167 E X |
| 1,587,758 | 6/1926 | Charavay | 273/167 E |
| 2,169,774 | 8/1939 | Taylor | 273/167 E X |
| 2,550,846 | 5/1951 | Milligan | 273/167 E |
| 3,468,544 | 9/1969 | Antonious | 273/167 E X |
| 3,997,170 | 12/1976 | Goldberg | 273/167 E X |

*Primary Examiner*—George J. Marlo

[57] ABSTRACT

A golf club head apparatus having a body of predetermined shape having a face, sole, top and rear sides and a hosel therein for the attachment of the shaft. One or more turning air vanes of predetermined shape are attached to the golf club head body for directing the flow of air in a predetermined pattern thereby. Each air vane is attached to the body in a predetermined spaced relationship to allow the flow of air around the air vane and between the air vane and the body to alter the aerodynamic characteristics of a golf club.

6 Claims, 7 Drawing Figures

GOLF CLUB HEAD

BACKGROUND OF THE INVENTION

The present invention relates to golf clubs, and especially to a golf club head of a predetermind shape having turning air vanes mounted thereon in a predetermined manner to reduce air drag on the club.

In the past, attempts have been made to reduce air drag on golf clubs by using traditional techniques used in the design of air foils to streamline the bodies of the golf club and by the utilization of spoilers or boundary layer strips, or the like, mounted on the rear of the golf club in accordance with classical aerodynamic theory. This has not generally proven successful in creating any significant reductions in the air drag of the golf club head. These prior art approaches assume a flow across the top and bottom of the club head with a breakaway of the flow accruing at the back edges of the club, so that vortex generators or boundary layer strips have been used to upset the breakaway of the air flow by creating controlled turbulence to fill the void behind the club and thus decrease the drag of the major body by more than the turbulence creating device increases the drag. In the case of a golf club, these prior art teachings have not proven significant in that the golf club head is a blunt object moving through air rather than a streamlined air foil.

Golf club heads having grooves or ribs found thereon can be seen in the Goldberg U.S. Pat. No. 3,997,170; in the Gordos U.S. Pat. No. 4,065,133; and in U.S. Pat. Des. No. 192,515. One prior U.S. Pat. No. 1,089,881, to Taylor, has grooves or ribs formed as feet for the golf club; while U.S. Pat. No. 2,083,189 to Crooker, has a golf club having an aerodynamic shape. In U.S. Pat. No. 3,468,544 to Antonious, a golf club wood has improved aerodynamic characteristics provided by one or more passageways or holes extending through the wood under the top surface of the club head and having outlets to the holes in the back of the club to produce a ram air exhaust through the club head into the wake region of the rear of the club head to raise the base pressure and decrease the base drag. The Antonious patent provides, as does the present invention, means for producing a ram air exhaust for decreasing drag, but Antonious does not have turning vanes mounted in a predetermined fashion nor spacing for the turning vanes forming air foils to produce a combined effect for reducing drag.

To solve the problem of drag in a golf club driver, my invention uses turning vanes added to the top, or to the top and bottom, to redirect the air flow and follow the shape of the club head. The air foils or vanes also act to produce a ram air exhaust effect and further reduction is accomplished by adding traditional drag reduction techniques to the shape of the club head.

The combination of the present invention utilizes turning vanes with a club head shaped to form an air foil cross-sectional dimension ratio of 3:1 front of air foil to back of club head to greatest height of club head and uses spacing posts to space the turning vanes found in an air foil shape which acts as vortex generators along with turning vanes to provide for a reduction of drag over conventional golf clubs. Drag has been reduced up to 41.3% at a wind speed of 200 feet per second in wind tunnel tests of the golf club head. The entire club, of course, would have a smaller percentage of drag reduction. In actual tests with a mechanical golfer, a conventional golf club was able to drive a ball from 240 to 257 yards with a mean of 249.36 yards with a standard deviation of 4.072 yards; while one embodiment of the present golf club drove balls from 260 yards to 275 yards with a means of 268.70 yards with a standard deviation of 4.358.

SUMMARY OF THE INVENTION

A golf club head is provided with a body having a predetermined shape along with a face, sole, top and rear sides and a hosel formed therein. One or more turning vanes are attached to the golf club head body for directing the flow of air in a predetermined pattern thereby and the turning vanes are attached in a predetermined spaced relationship to the golf club head body to form a passageway for the flow of air between the turning vanes and the body thereby altering the aerodynamic characteristics of the golf club head. The turning vanes are attached with spacers, which may be formed in the shape of air foils which act as vortex generators. In one embodiment, the golf club head is aerodynamically shaped by reducing the face area of the club, and may have a portion removed from the top to form an angled channel directly under the turning vane.

BRIEF DESCRIPTION OF THE DRAWINGS

Other objects, features and advantages of the present invention will be apparent from the written description and the drawing in which.

DESCRIPTION OF THE PREFERRED EMBODIMENT

Figure 1:
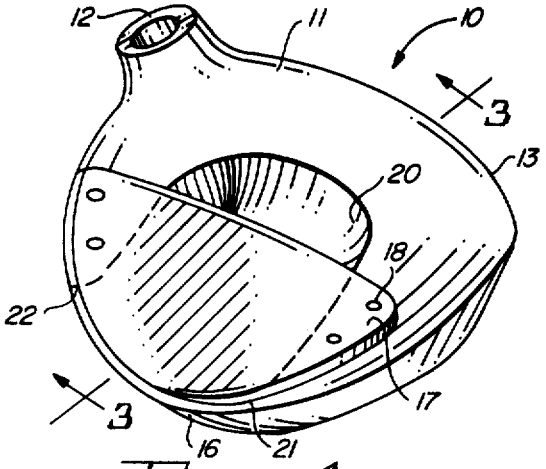
FIG. 1 shows a perspective view of a preferred embodiment of the present invention.
Figure 2:
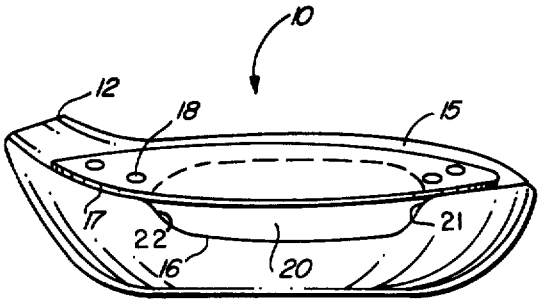
FIG. 2 is a rear elevation of the embodiment of FIG. 1.
Figure 3:
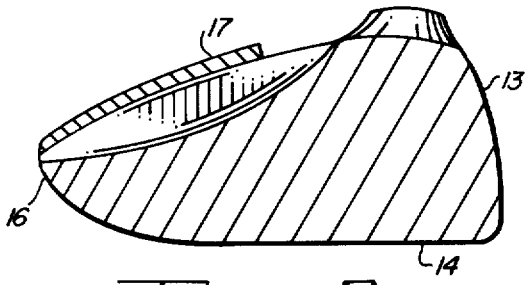
FIG. 3 is a sectional view taken on the line 3—3 of FIG. 1.
Figure 4:
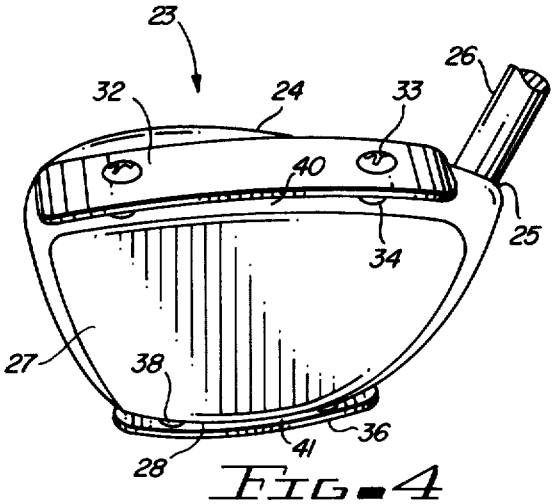
FIG. 4 is a front perspective view of a second embodiment of the present invention having two vanes mounted thereon.
Figure 5:
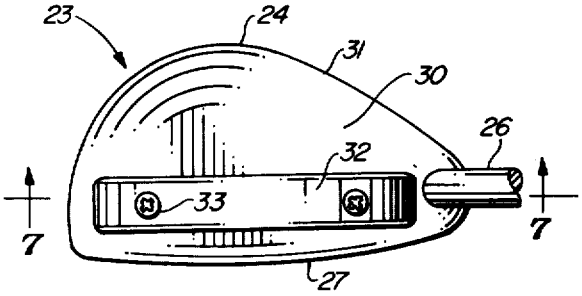
FIG. 5 is a top elevation of the embodiment of FIG. 4.
Figure 7:
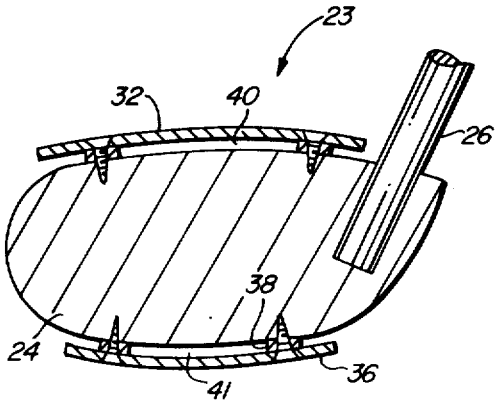
FIG. 7 is a sectional view taken on the line 7—7 of FIG. 5.

Referring to FIGS. 1 through 3 of the drawings, a preferred embodiment of a golf club head 10 is illustrated having a body 11 having a hosel 12 on one side thereof, a face 13, a sole 14, a top 15, a rear portion 16. The club body 11 has a reduced face portion 13 to provide a more nearly suitable aerodynamic design having the ratio of its greatest height to distance between air foil front and the the rear 16 of the head of approximately 1:3. Air foil front is defined as the front of an imaginary air foil shape formed on the front of the face of the golf club head. That is to say, if the golf club head were shaped on the leading edge like a true air foil rather than a striking face, the front of the true air foil would be the air foil front. A turning vane 17 is mounted with screws 18 to the top of the head over a removed portion 20. The metal vane 17 is used to adjust the balance in the club head, while the removed portion 20 reduces the overall weight. The removed portion 20 has a curved lip 21 on one edge, and a curved lip 22 on the other edge, to provide a turning shape to direct the air flow passing therethrough beneath air vane 17 in a predetermined fashion to one side of the club. The removed portion 20 forms a passageway, which in combination with a turning vane 17, redirects the air flow over the club head to follow the shape through and over the vane 17 to follow the shape of the club head.

Figure 6:
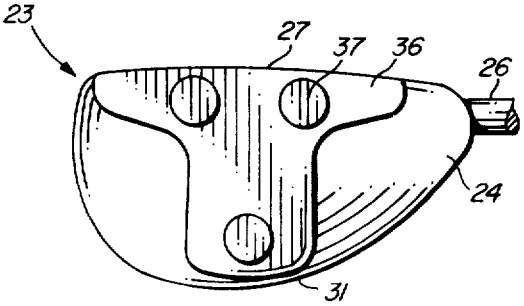
FIG. 6 is a bottom elevation of the embodiment of FIG. 4.

The embodiment shown in FIGS. 4 through 7 has the golf club head 23 having a club head body 24 having a hosel 25 with a shaft 26 protruding therefrom and a face 27, a sole portion 28, top 30 and a rear portion 31. A turning vane 32 has been attached to the top portion 30 of the body 24 with screws 33 and spacers 34. Spacers 34 may be aerodynamically shaped to act as vortex generators while spacing the turning vane 32 a predetermined distance from the top 30 of the wood body 24. A bottom turning vane 36 has a T-shape, as seen in FIG. 6, and is held by a plurality of screws 37 having spacers 38 between the vane 36 and the bottom 28 of the wood 24. The spacers 38 may also be shaped in a tear drop air foil design. The bottom vane 36 acts as the sole plate for the wood club 23, thereby allowing a smaller cross-section face 27 having top and bottom vanes for controlling the air flow, while having spacers 34 and 38 to act as vortex generators. The vane 32 thus forms a passageway 40, while vane 36 forms a passageway 41 between the vanes and the club body 24.

The embodiments shown in FIGS. 1 through 7 utilize the combination of a narrowed golf club head body more closely approaching a dimension of 1:3 of the greatest cross-sectional height to air foil front-to-rear distance, while having turning vanes and vortex generators to direct the flow of air and to reduce the drag components. The vanes produce a ram jet type air flow pattern over the club body to minimize the drag to make the edge of the blunt object act like a streamlined object to assure minimizing of drag and to increase the distance an individual can hit a golf ball with a golf club incorporating the present invention.

It should be clear at this time that an improved golf club head has been provided, but it should also be clear that the invention shown and described is not to be limited to the forms shown, which are to be considered illustrative rather than restrictive.

I claim:

1. A golf club head comprising in combination:

a golf club head body having a predetermined shape and having a face, sole, top and rear sides and a hosel formed therein;

at least one air turning vane attached to said club head for directing the flow of air in a predetermined pattern thereby;

attaching means for attaching said air turning vane to said body in a predetermined spaced relationship to said golf club head body to form a passageway for the flow of air between said air vane and said body, thereby altering the aerodynamic characteristics of a golf club; and said golf club head body having a concave curved area formed in the top portion thereof and said turning air vane being attached thereover to form a passageway between said air vane and said concaved curved area.

2. A golf club head in accordance with claim 1, in which said golf club head body has a maximum height to air foil front to rear distance ratio of approximately 1:3.

3. A golf club head in accordance with claim 1, in which said concave curved area curves from the center portion of the top of said golf club head body.

4. A golf club head in accordance with claim 3, in which said concave curved area begins a predetermined distance from the face of said golf club head body and extends to the rear of said golf head body.

5. A golf club head in accordance with claim 1, in which a pair of air turning vanes are attached to said golf club head body, one on the top thereof and one to the sole thereof to form a sole plate for said golf club head, both said air turning vanes being spaced a predetermined distance from said golf club head body.

6. A golf club head in accordance with claim 1, in which said turning vane attaching means includes screws and has spacers between said turning vane and said golf club head body, said spacers being tear drop shaped air foils.

* * * * *